US011255236B2

(12) United States Patent
Okamoto

(10) Patent No.: US 11,255,236 B2
(45) Date of Patent: Feb. 22, 2022

(54) VALVE GEAR AND ENGINE

(71) Applicant: YAMAHA HATSUDOKI KABUSHIKI KAISHA, Iwata (JP)

(72) Inventor: Yasuo Okamoto, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 17/114,559

(22) Filed: Dec. 8, 2020

(65) Prior Publication Data

US 2021/0199031 A1 Jul. 1, 2021

(30) Foreign Application Priority Data

Dec. 27, 2019 (JP) ..... JP2019-239843

(51) Int. Cl.
*F01M 9/10* (2006.01)
*F01L 1/053* (2006.01)
*F01L 1/18* (2006.01)

(52) U.S. Cl.
CPC ..... *F01M 9/105* (2013.01); *F01L 1/053* (2013.01); *F01L 1/18* (2013.01); *F01L 1/181* (2013.01); *F01L 2001/0537* (2013.01); *F01L 2001/186* (2013.01); *F01L 2810/02* (2013.01)

(58) Field of Classification Search
CPC ... F01L 1/185; F01L 2305/00; F01L 13/0005; F01L 1/18; F01L 1/2405; F01L 2001/186; F01L 13/0036; F01L 1/053; F01L 1/181; F01L 2001/0537; F01L 2810/02; F01L 1/26; F01M 9/105
See application file for complete search history.

(56) References Cited

U.S. PATENT DOCUMENTS

2013/0146008 A1* 6/2013 Stoody ..... F01L 1/185 123/90.39
2016/0108780 A1* 4/2016 Sugiura ..... F01L 13/0005 123/90.16
2016/0319706 A1* 11/2016 McConville ..... F01L 1/2405
(Continued)

FOREIGN PATENT DOCUMENTS

DE 195 26 285 A1 1/1997
DE 10 2015 223 565 A1 6/2017
(Continued)

OTHER PUBLICATIONS

JP-2008267248, Nov. 2008, English Language Machine Translation.*
(Continued)

*Primary Examiner* — Patrick Hamo
*Assistant Examiner* — Wesley G Harris
(74) *Attorney, Agent, or Firm* — Keating and Bennett, LLP

(57) ABSTRACT

An engine includes a cylinder head including a first oil path and a second oil path. The cylinder head includes a valve gear including a first support and a second support that support a rocker shaft. The first support includes, on its outer surface, a first constriction located at an inlet of a connection-switching third oil path and connected to the first oil path, and a second constriction connected to the second oil path. The second support includes, on its outer surface, a third constriction connected to the first oil path, and a fourth constriction located at an inlet of a lubrication fourth oil path and connected to the second oil path.

11 Claims, 16 Drawing Sheets

(56) References Cited

U.S. PATENT DOCUMENTS

| | | | | |
|---|---|---|---|---|
| 2017/0138230 | A1* | 5/2017 | Radulescu | F01L 13/0005 |
| 2017/0298784 | A1* | 10/2017 | Okamoto | F01L 1/053 |
| 2018/0371961 | A1 | 12/2018 | Bogdanski | |

FOREIGN PATENT DOCUMENTS

| | | | | | |
|---|---|---|---|---|---|
| EP | 3 418 513 | A1 | | 12/2018 | |
| EP | 3 441 583 | A1 | | 2/2019 | |
| EP | 3 647 557 | A1 | | 5/2020 | |
| JP | S63-117110 | A | | 5/1988 | |
| JP | 04-284110 | A | | 10/1992 | |
| JP | 04-123313 | U | | 11/1992 | |
| JP | 2008-175146 | A | | 7/2008 | |
| JP | 2008-267248 | A | | 11/2008 | |
| JP | 2008267248 | A | * | 11/2008 | F01L 13/0005 |
| JP | 2009-091971 | A | | 4/2009 | |
| JP | 2010-127104 | A | | 6/2010 | |
| JP | 4931680 | B2 | | 5/2012 | |
| JP | 2016-094901 | A | | 5/2016 | |
| JP | 2017-061939 | A | | 3/2017 | |
| JP | 6220987 | B2 | | 10/2017 | |
| JP | 6458090 | B2 | | 1/2019 | |
| WO | 2013/159120 | A1 | | 10/2013 | |

OTHER PUBLICATIONS

Official Communication issued in corresponding European Patent Application No. 20216680.7, dated Jun. 7, 2021.
Okamoto, "Lost Motion Mechanism, Valve Gear and Engine", U.S. Appl. No. 17/114,560, filed Dec. 8, 2020.

* cited by examiner

VALVE GEAR AND ENGINE

CROSS REFERENCE TO RELATED APPLICATIONS

This application claims the benefit of priority to Japanese Patent Application No. 2019-239843 filed on Dec. 27, 2019. The entire contents of this application are hereby incorporated herein by reference.

BACKGROUND OF THE INVENTION

1. Field of the Invention

The present invention relates to valve gears and engines, and more specifically to a valve gear and an engine able to change a lift amount, an opening timing, and a closing timing of a valve.

2. Description of the Related Art

JP-A 2009-91971 discloses an example pertinent to conventional techniques of this kind. JP-A 2009-91971 discloses a variable valve mechanism which includes a rocker arm provided with a switching mechanism for hydraulically changing a valve opening amount, and two rocker arm support members provided at a widthwise distance of the rocker arm for supporting the rocker arm. In the variable valve mechanism, each rocker arm support member has a fitting portion for fitting into an attaching hole formed in a cylinder head, a protruding portion protruding from the cylinder head, and a support portion formed in the protruding portion. Two end portions of a rocker shaft (a pivot pin) are pressed into through-holes at support portions of the two rocker arm support members, so that the rocker arm is supported pivotably via the rocker shaft. The rocker arm has an input member which abuts on a rotating cam, and an output member which abuts on the valve. Also, in order to transmit hydraulic pressure which is supplied from outside to the switching mechanism, an oil path is formed which comes from outside through one of the rocker arm support members, through the rocker shaft, through the rocker arm, to a hydraulic chamber in the switching mechanism. With the above, the switching mechanism hydraulically switches between a connected state in which the input member and the output member are mutually connected so that they are unable to move relatively from each other, and a non-connected state in which the connection is not established, and this switching changes the valve opening amount.

While JP-A 2009-91971 discloses an arrangement for transmitting hydraulic pressure to the switching mechanism to perform connection-switching as described above, it discloses nothing about means for lubricating regions of sliding movement between the rocker arm and the rotating cam, and therefore, no description is provided about means for stabilizing hydraulic pressure of the connection-switching or hydraulic pressure of the lubrication.

SUMMARY OF THE INVENTION

Therefore, preferred embodiments of the present invention provide valve gears and engines that are each able to stably supply hydraulic pressure to switch the connection of the rocker arm and hydraulic pressure to lubricate between the rocker arm and the cam.

According to a preferred embodiment of the present invention, a valve gear for a cylinder head including a first oil path and a second oil path includes a rocker shaft; a first support that supports a first end region of the rocker shaft; a second support that supports a second end region of the rocker shaft; a rocker arm including a first arm portion supported pivotably by the rocker shaft and pivoted by a cam, and a second arm portion supported pivotably by the rocker shaft to drive a valve; a switch provided in the rocker arm to hydraulically connect and disconnect the first arm portion and the second arm portion to/from each other; a third oil path extending through the first support, the rocker shaft, and the rocker arm to the switch to supply a hydraulic pressure to the switch; and a fourth oil path extending through the second support and the rocker shaft to a region between the rocker shaft and the rocker arm to lubricate areas between the cam and the rocker arm. In this structural arrangement, the first support includes, on its outer surface, a first concave portion located at an inlet of the third oil path and to connect to the first oil path, and a second concave portion to connect to the second oil path; and the second support includes, on its outer surface, a third concave portion to connect to the first oil path, and a fourth concave portion located at an inlet of the fourth oil path and to connect to the second oil path.

In a hypothetical case in which neither of the first support and the second support is provided with any of the first concave portion through the fourth concave portion; the first oil path crosses the first support and the second support and the second oil path crosses the first support and the second support when the first support and the second support are installed to the cylinder head; and the first oil path communicates with the third oil path while the second oil path communicates with the fourth oil path; then, the first oil path and the second oil path would have a decreased cross-sectional area where they cross the first support or the second support. These decreases in the cross-sectional area in the first oil path or the second oil path will delay hydraulic pressure response in the oil to switch the connection supplied from the first oil path to the third oil path, and in lubrication oil supplied from the second oil path to the fourth oil path. The problem becomes more significant with an increasing amount of overlap between the first oil path and the first support or the second support, and with an increasing amount of overlap between the second oil path and the first support or the second support.

According to a preferred embodiment of the present invention, the first support includes on its outer surface the first concave portion connected to the first oil path such that it becomes possible to reduce a decrease in a cross-sectional area in the first oil path where the junction is made with the first support, and the second concave portion connected to the second oil path such that it becomes possible to reduce a decrease in a cross-sectional area in the second oil path where the junction is made with the first support. Also, the second support includes on its outer surface the third concave portion connected to the first oil path such that it becomes possible to reduce a decrease in a cross-sectional area in the first oil path where the junction is made with the second support, and the fourth concave portion connected to the second oil path such that it becomes possible to reduce a decrease in a cross-sectional area in the second oil path where the junction is made with the second support. Therefore, it is possible to reduce a delayed response in the connection-switching hydraulic pressure in the rocker arm, and in the lubrication hydraulic pressure between the rocker arm and the cam, and to supply a stable hydraulic pressure.

Preferably, each of the first concave portion and the second concave portion includes a first constriction and a second constriction extending entirely around the outer circumference of the first support, and each of the third concave portion and the fourth concave portion includes a third constriction and a fourth constriction extending entirely around the outer circumference of the second support. In this case, by providing the first constriction and the second constriction around the entire circumference of the outer surface of the first support, and providing the third constriction and the fourth constriction around the entire circumference of the outer surface of the second support, it becomes possible to further reduce the amount of decrease in the cross-sectional area of the first oil path which is connected to the first constriction and the third constriction, and the amount of decrease in the cross-sectional area of the second oil path which is connected to the second constriction and the fourth constriction.

Further preferably, the first support and the second support have an identical or substantially identical outer surface shape. In this case, it is possible to substantially communize machining processes for the outer surfaces of the first support and the second support, and therefore it is possible to reduce costs.

Further, preferably, the valve gear further includes a first regulator to connect the first support with the rocker shaft to regulate movement in a rotational direction and an axial direction of the rocker shaft. In this case, by regulating movement in the rotational and axial directions of the rocker shaft using the first regulator, it is possible to maintain positions of the first support and the rocker shaft so as to make communication between the oil path inside the first support in the third oil path for connection-switching of the rocker arm and the oil path inside the rocker shaft at an appropriate position.

Preferably, the first regulator includes a press-fit pin. In this case, since the first regulator is a small member, i.e., the press-fit pin, a high level of freedom is provided in the layout making it possible to fix the rocker shaft and the first support reliably with each other.

Further preferably, the valve gear further includes a second regulator to connect the second support with the rocker shaft to regulate movement of the rocker shaft in directions perpendicular or substantially perpendicular to the axial direction. In this case, by regulating movement of the rocker shaft in directions perpendicular or substantially perpendicular to the axis of the rocker shaft (including left-right directions and up-down directions of the rocker shaft) using the second regulator, it becomes possible to stabilize the position of the rocker shaft, and to pivot the rocker arm stably.

Further, preferably, the valve gear further includes a retainer provided on an outer side of the second regulator in the rocker shaft to prevent the second support from detaching from the rocker shaft. In this case, it is possible, with the retainer, to prevent the second support, the rocker shaft, and the rocker arm from separating from each other, which makes it easy to handle the valve gear as an assembly during transportation, for example.

Preferably, the retainer includes a circlip. In this case, since the circlip adequately prevents separation yet is easy to attach/detach, this structural arrangement makes it easy to perform repair work for the rocker arm, and reduce costs.

According to a preferred embodiment of the present invention, an engine includes a cylinder head including a first insertion hole and a second insertion hole, and the above-described valve gear including the first support and the second support inserted into the first insertion hole and the second insertion hole, respectively. In this structural arrangement, in the first support, the first oil path and the third oil path communicate with each other via the first concave portion, and the second concave portion is connected to the second oil path; while in the second support, the third concave portion is connected to the first oil path, and the second oil path and the fourth oil path communicate with each other via the fourth concave portion.

In a preferred embodiment of the present invention, the valve gear is installed on the cylinder head by inserting the first support and the second support into the first insertion hole and the second insertion hole, respectively. Then, the first concave portion and second concave portion of the first support are connected to the first oil path and the second oil path, respectively, while the third concave portion and fourth concave portion of the second support are connected to the first oil path and the second oil path, respectively. Therefore, it is possible to reduce a decrease in a cross-sectional area in the first oil path and the second oil path, and as a result, it is possible to reduce a delayed response in the connection-switching hydraulic pressure of the rocker arm, and in the lubrication hydraulic pressure between the rocker arm and the cam, and to supply a stable hydraulic pressure.

Preferably, the second support is located farther downstream in the second oil path than the first support. In a hypothetical case in which neither of the first support and the second support is provided with any of the first concave portion through the fourth concave portion; the second support is located farther downstream in the second oil path than the first support; and both of the first support and the second support cross with the second oil path; then the second oil path has a reduced cross-sectional area at a location where it crosses the first support. Therefore, there may be cases in which a sufficient amount of lubrication oil will not be supplied between the rocker arm and the cam via the fourth oil path that extends through the second support and is located farther downstream than the location; and insufficient lubrication will destabilize the pivotal movement of the rocker arm with respect to the rotating movement of the cam. According to a preferred embodiment of the present invention, it is possible to reduce a decrease in the cross-sectional area in the second oil path where the junction is made with the first support, and to supply a sufficient amount of lubrication oil between the rocker arm and the cam, and thus stabilize the pivoting movement of the rocker arm with respect to the rotating movement of the cam. Therefore, preferred embodiments of the present invention are suitable for cases in which the second support is located farther downstream side in the second oil path than the first support.

Further preferably, the cylinder head includes a plurality of cylinders located axially along the rocker shaft, the first insertion hole and the second insertion hole are provided for each cylinder and located axially along the rocker shaft, the valve gear is provided for each cylinder, and each of the first oil path and the second oil path extends axially along the rocker shaft and is shared by the plurality of valve gears. In this case, it is possible to reduce the amount of decrease in the cross-sectional area in the first oil path where the junction is made with the first support and the second support in each valve gear, and to reduce the amount of decrease in the cross-sectional area in the second oil path where the junction is made with the first support and the second support in each valve gear. Therefore, it is possible to reduce a gap in the response in the connection-switching hydraulic pressure of the rocker arm between the valve gears, and to supply a sufficient amount of lubrication oil even between the rocker arm and the cam are located far from the hydraulic pressure source. Therefore, preferred embodiments of the present invention are suitable for a multi-cylinder engine which includes a plurality of cylinders disposed in-line.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
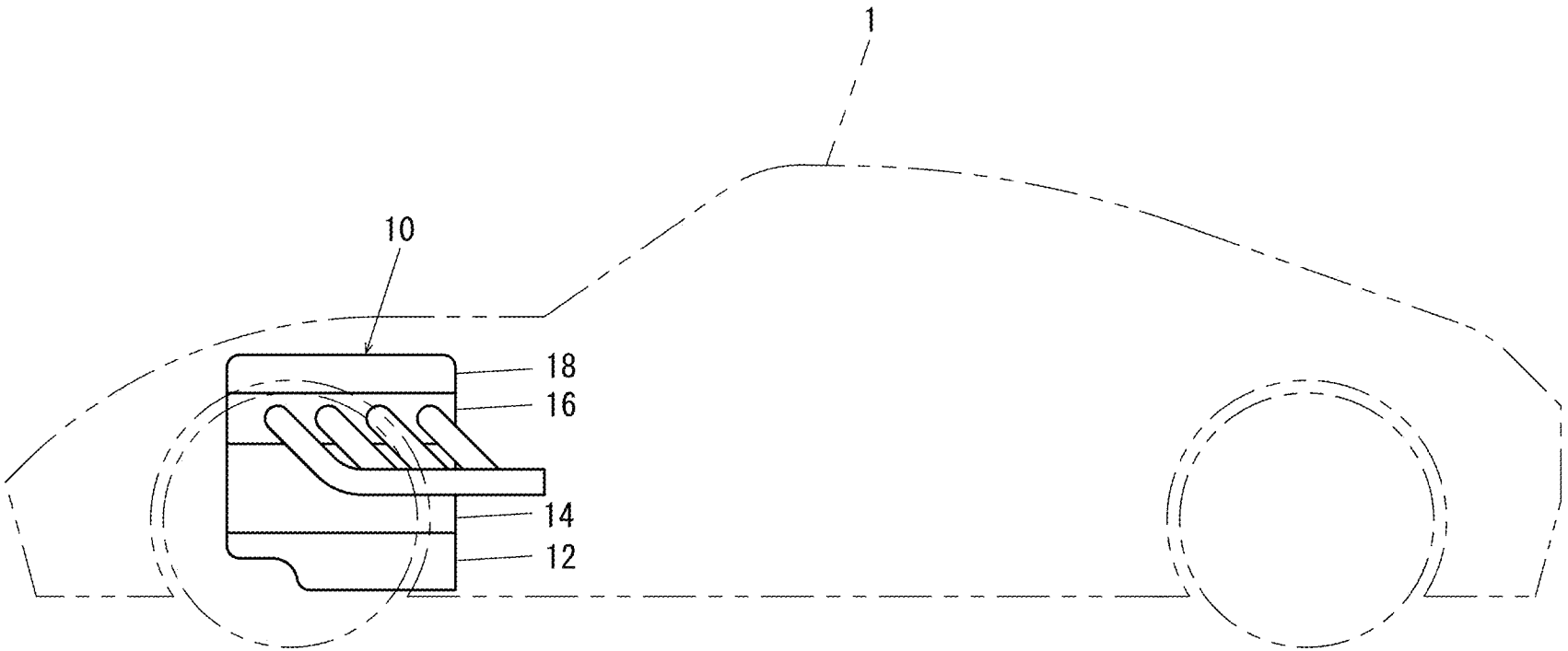
FIG. 1 is an illustrative drawing which shows an example in which an engine according to a preferred embodiment of the present invention is installed in an automobile.

Referring to FIG. 1, an engine 10 according to a preferred embodiment of the present invention is installed in an automobile 1 and is used as a propelling source of the automobile 1.

Figure 2:
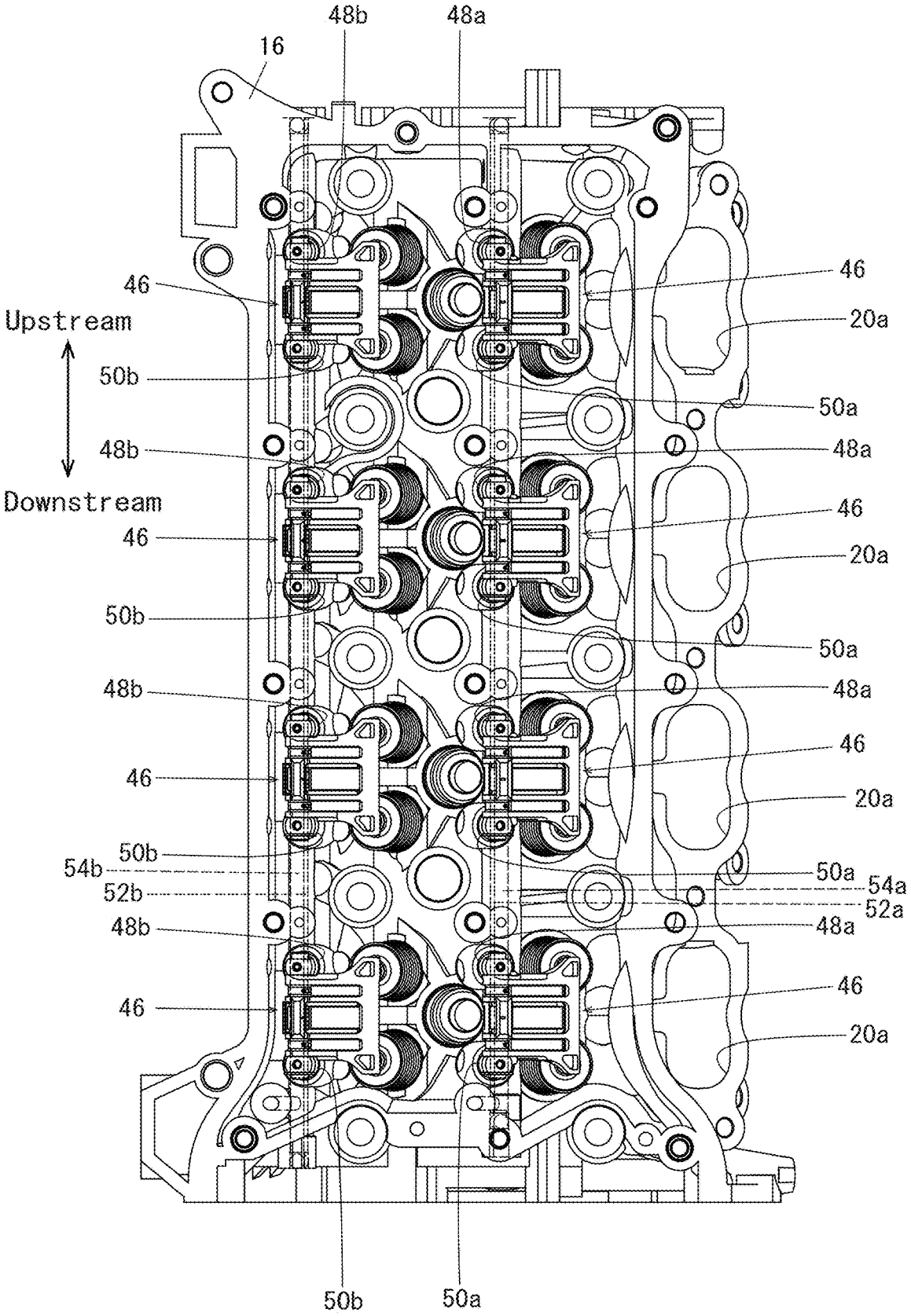
FIG. 2 is a plan view which shows a state in which valve gears, intake valves, exhaust valves and other components are attached to a cylinder head.
Figure 3:
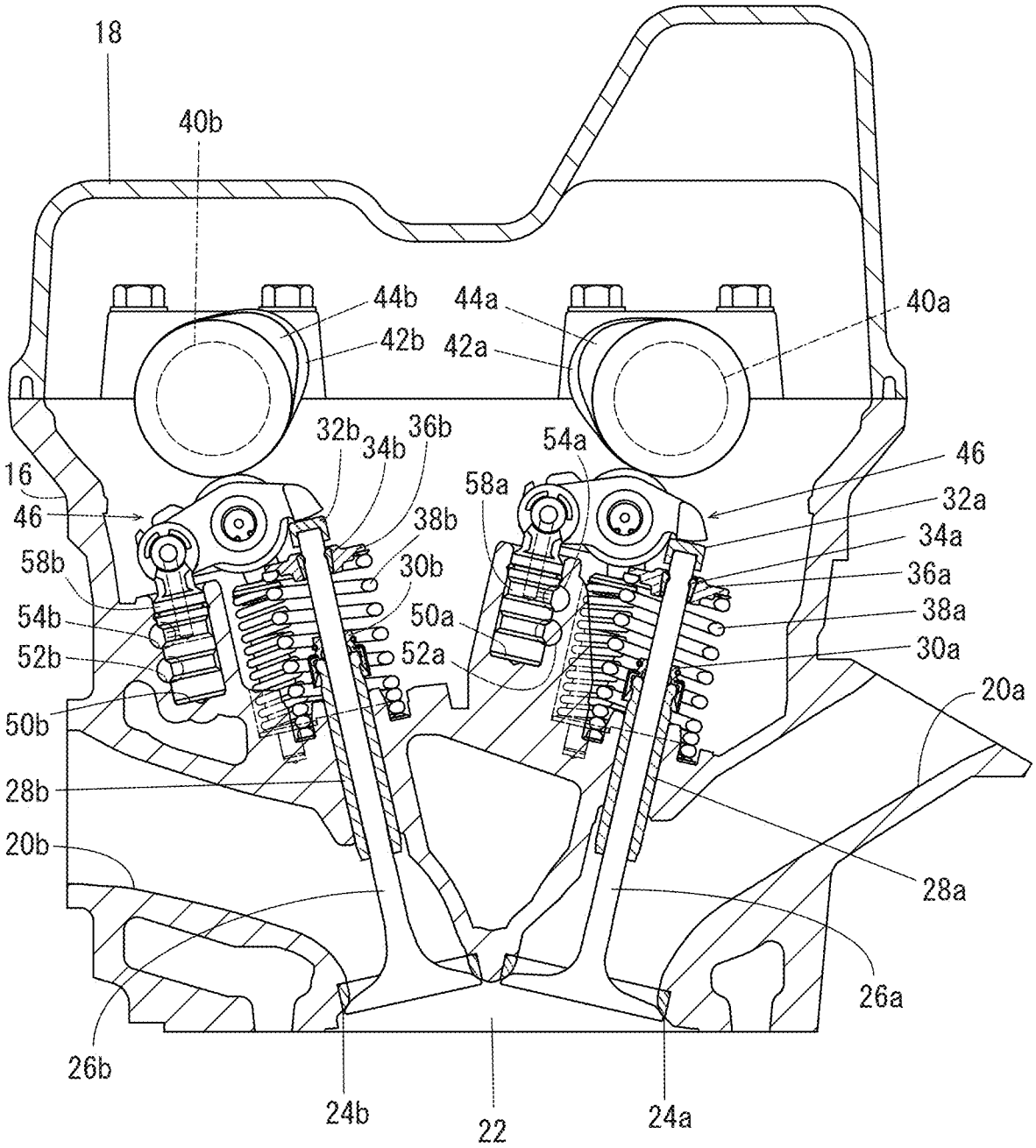
FIG. 3 is a partial sectional illustrative drawing which shows a portion of the engine.
Figure 4:
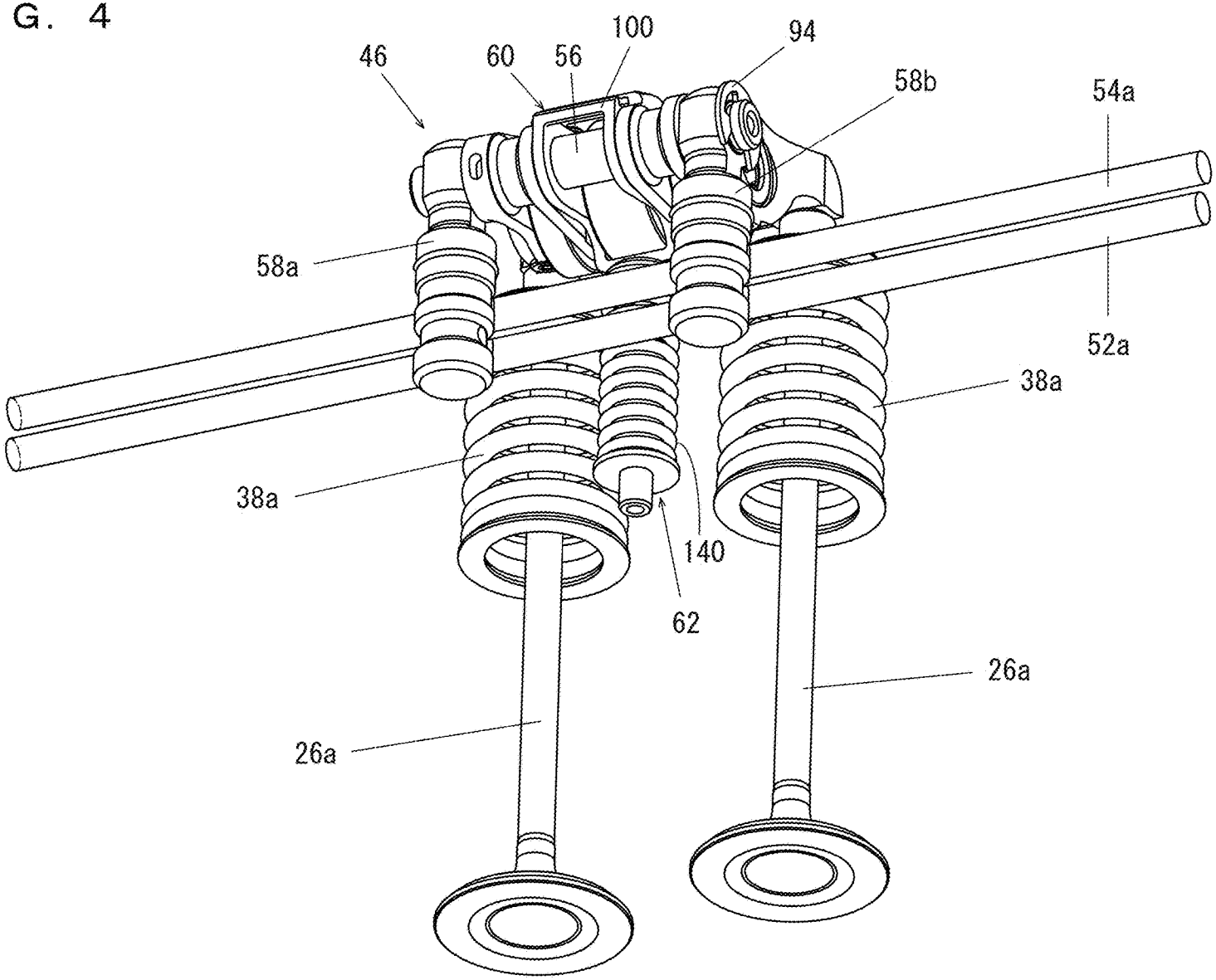
FIG. 4 is a perspective view which shows the valve gear, the intake valves, a first oil path, a second oil path and other components on an intake side according to a preferred embodiment of the present invention.
Figure 5:
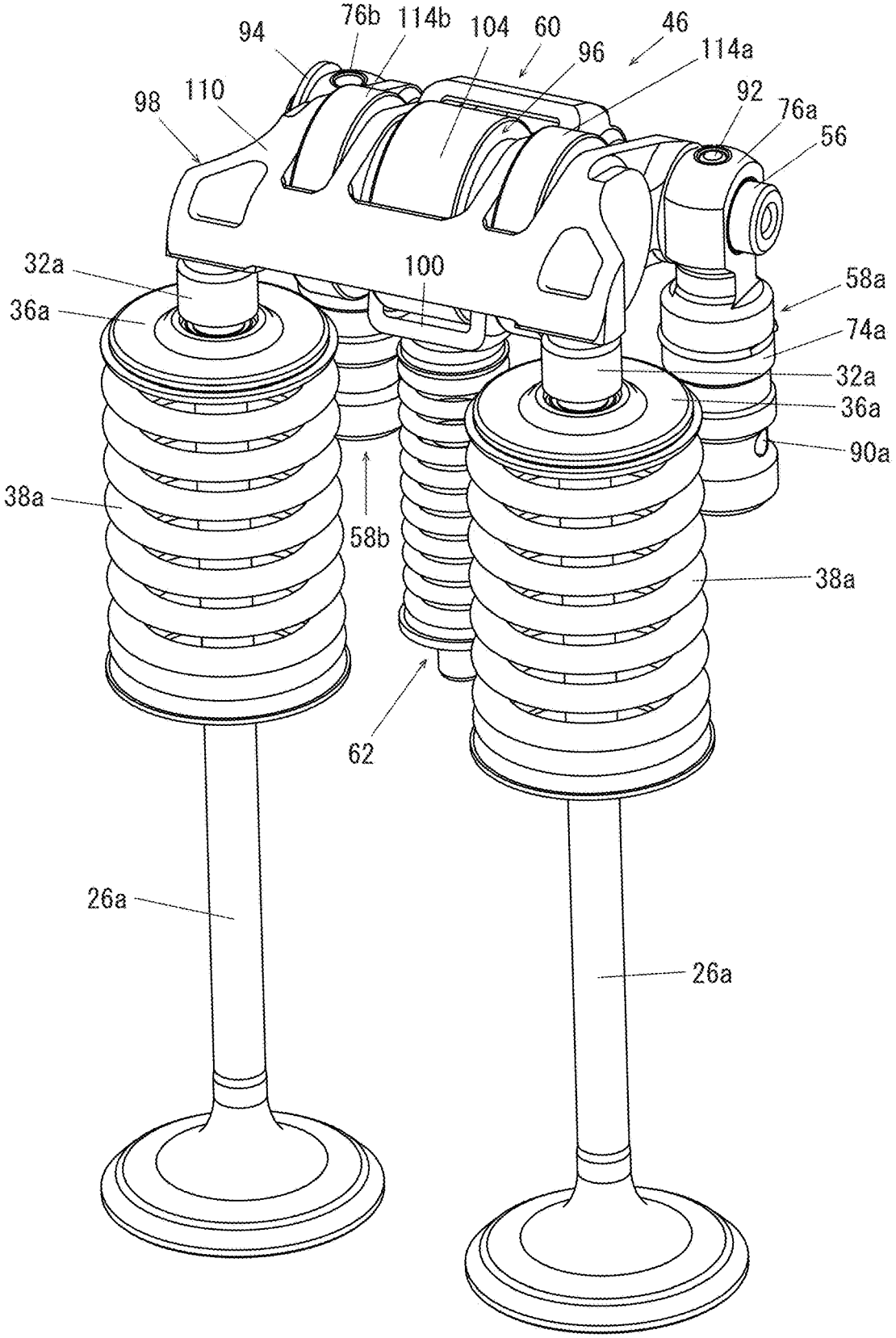
FIG. 5 is a perspective view which shows the valve gear and other components.
Figure 6:
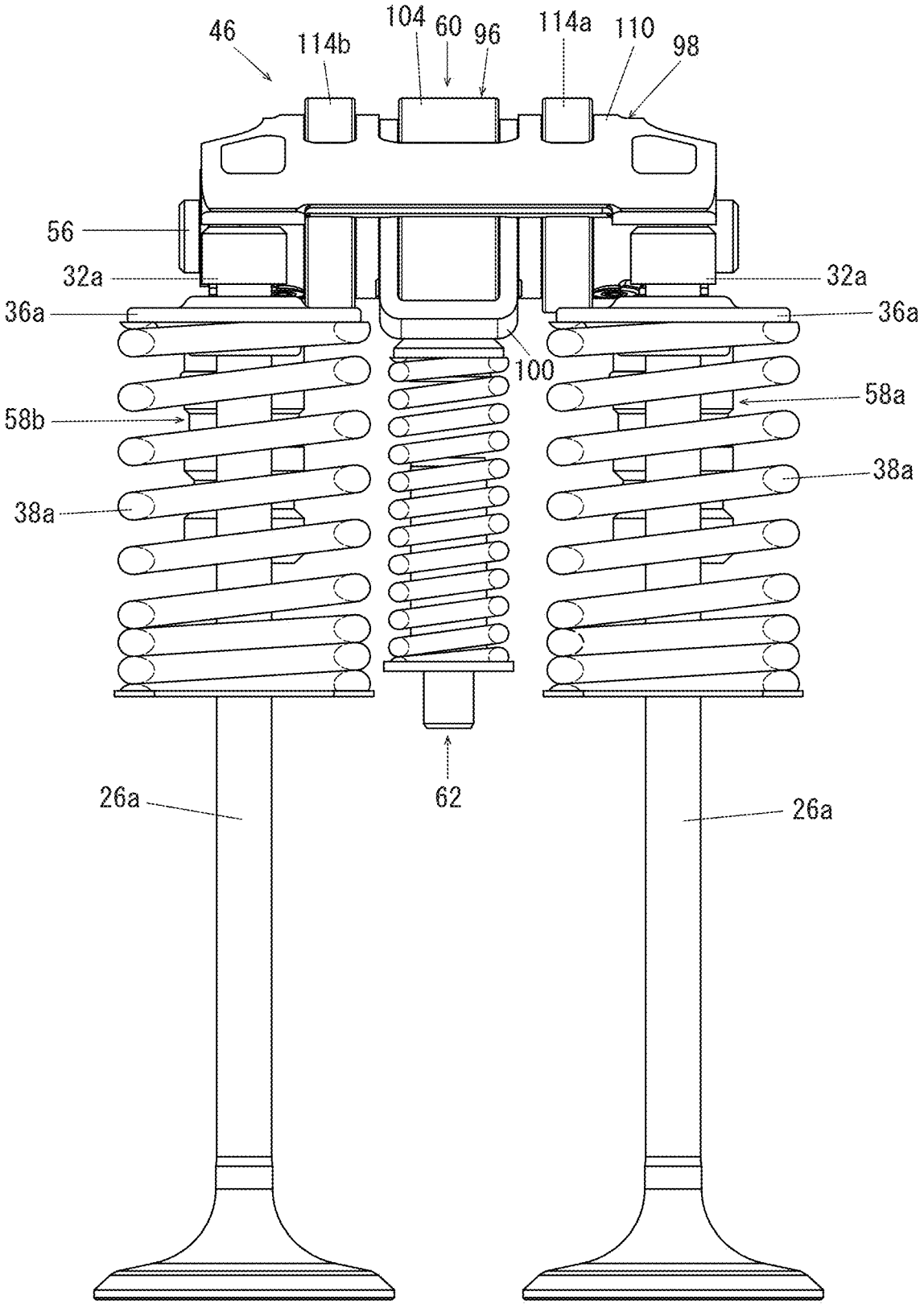
FIG. 6 is a front view which shows the valve gear and other components.

Referring also to FIG. 2 and FIG. 3, the engine 10 is a multi-cylinder engine which includes a plurality of cylinders, and in the present preferred embodiment, is a straight four-cylinder engine. The engine 10 includes a crank case 12 which houses a crank shaft (not illustrated), a cylinder block 14 connected with the crank case 12, a cylinder head 16 connected with the cylinder block 14, and a cylinder head cover 18 attached to the cylinder head 16.

The cylinder block 14 includes a plurality of cylinders located axially along a rocker shaft 56 (which will be described below). For each cylinder, a combustion chamber 22 is provided in the cylinder block 14 and the cylinder head 16. For each combustion chamber 22, the cylinder head 16 includes an intake port 20*a* and an exhaust port 20*b*. The intake port 20*a* communicates with the combustion chamber 22 via two air inlets 24*a*, while the exhaust port 20*b* communicates with the combustion chamber 22 via two exhaust outlets 24*b*.

For each cylinder, the cylinder head 16 is provided with two intake valves 26*a* and two exhaust valves 26*b* assembled thereto. Each intake valve 26*a* opens/closes a corresponding one of the air inlets 24*a* of the intake port 20*a*, while each exhaust valve 26*b* opens/closes a corresponding one of the exhaust outlets 24*b* of the exhaust ports 20*b*.

The intake valve 26*a* is slidably supported by the cylinder head 16 via a cylindrical sleeve 28*a*. At an end of the sleeve 28*a*, on the intake valve 26*a*, a valve stem seal 30*a* is attached. A tappet 32*a* is fitted to a tip of the intake valve 26*a*. A valve spring retainer 36*a* is fixed to the intake valve 26*a* via a cotter 34*a*. Between the cylinder head 16 and the valve spring retainer 36*a*, a valve spring 38*a* is provided to urge the intake valve 26*a* with a force (in upward direction in FIG. 3) to close the air inlet 24*a*. The valve spring 38*a* is a compression coil spring. It should be noted here that the exhaust valve 26*b* and components nearby are the same as the intake valve 26*a* and those nearby. Therefore, the exhaust valve 26*b* and components nearby will not be described herein since they should be clear from the description given above by replacing the letter "a" of alphanumeric reference code of the intake valve 26*a* and other components with the letter "b".

The cylinder head 16 rotatably supports an intake cam shaft 40*a* and an exhaust cam shaft 40*b* each extending axially along the rocker shaft 56. The intake cam shaft 40*a* is provided, for each cylinder, with an intake cam 42*a* which makes sliding contact with a first arm portion 96 that will be described below, and two intake cams 44*a* which make sliding contact with a second arm portion 98 that will be described below. The exhaust cam shaft 40*b* is provided, for each cylinder, with an exhaust cam 42*b* which makes sliding contact with the first arm portion 96, and two exhaust cams 44*b* which make sliding contact with the second arm portion 98.

The cylinder head 16 is provided, for each cylinder, with a valve gear 46 for intake, and a valve gear 46 for exhaust. The valve gear 46 for intake receives a force from the intake cam 42*a* or the intake cam 44*a* to open/close the intake valve 26*a*. The valve gear 46 for exhaust receives a force from the exhaust cam 42*b* or the exhaust cam 44*b* to open/close the exhaust valve 26*b*.

The cylinder head 16 is provided, for each valve gear 46 for intake, with a first insertion hole 48*a* and a second insertion hole 50*a* to attach the valve gear 46, and for each valve gear 46 for exhaust, with a first insertion hole 48*b* and a second insertion hole 50*b* to attach the valve gear 46. The first insertion hole 48*a* and the second insertion hole 50*a* are provided for each cylinder and located axially along the rocker shaft 56. The first insertion hole 48*b* and the second insertion hole 50*b* are provided for each cylinder and located axially along the rocker shaft 56.

The cylinder head 16 is provided, on the side where the valve gears 46 for intake are located, with a first oil path 52*a* for connection-switching, and a second oil path 54*a* for lubrication; and on the side where the valve gears 46 for exhaust are located, with a first oil path 52*b* for connection-switching, and a second oil path 54*b* for lubrication. The first oil paths 52*a*, 52*b* and the second oil paths 54*a*, 54*b* extend lengthwise of the cylinder head 16, with the upstream side being an upper side in FIG. 2 and the downstream side being a lower side therein. Each of the first oil path 52*a* and the second oil path 54*a* is shared by the valve gears 46 for intake and extends axially along the rocker shaft 56. Each of the first oil path 52*b* and the second oil path 54*b* is shared by the valve gears 46 on the exhaust-side and extends axially along the rocker shaft 56. Also, each of the second oil paths 54*a*, 54*b* is positioned at a higher location than the first oil paths 52*a*, 52*b*.

Hereinafter, description will cover the valve gears 46 on the intake side. The valve gears 46 on the exhaust side are configured the same way and can be easily understood, so that duplicate description thereof will be omitted.

Referring to FIG. 4 through FIG. 9, the valve gear 46 includes the rocker shaft 56. The rocker shaft 56 includes a first end region which is supported by a first support 58*a*. The rocker shaft 56 includes a second end region which is supported by the second support 58*b*. The rocker shaft 56 pivotably supports a rocker arm 60 between a first support 58*a* and the second support 58*b*. Also, the valve gear 46 includes a lost motion mechanism 62 which acts on the rocker arm 60.

Figure 10:
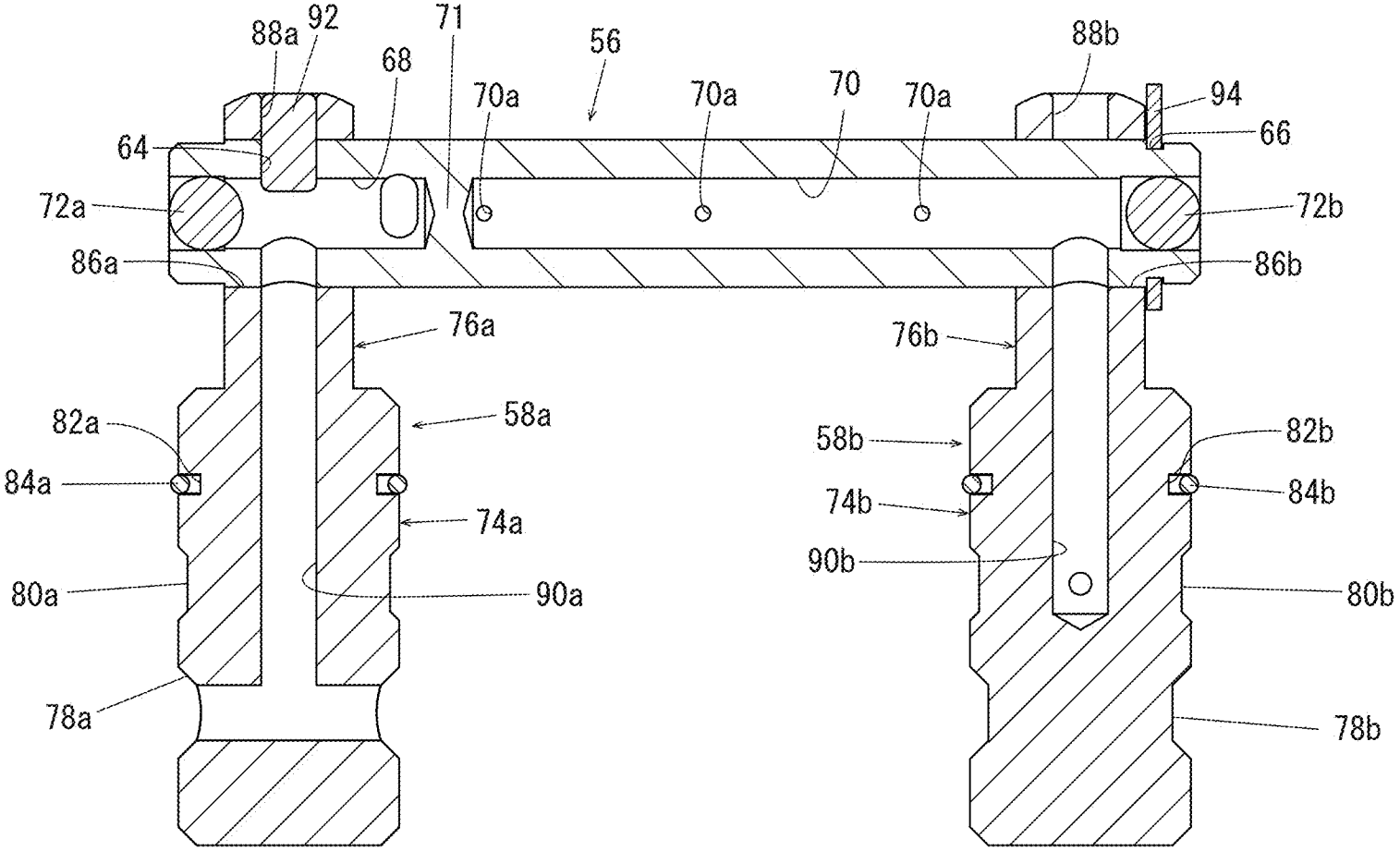
FIG. 10 is a sectional view which shows a first support, a second support, and a rocker shaft.
Figure 11:
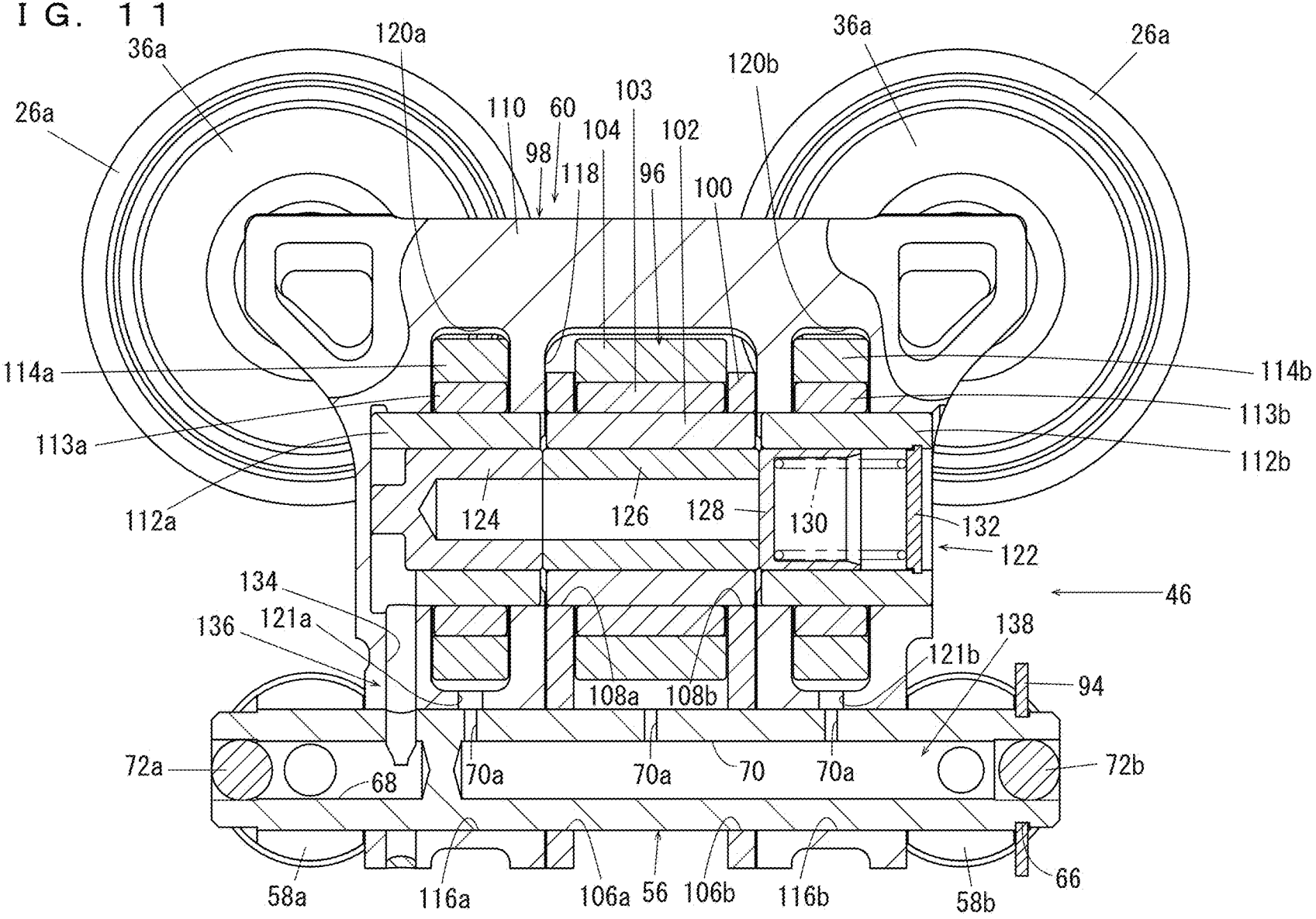
FIG. 11 is an illustrative sectional view which shows the valve gear and other components when a switch assumes a non-connected state.
Figure 12:
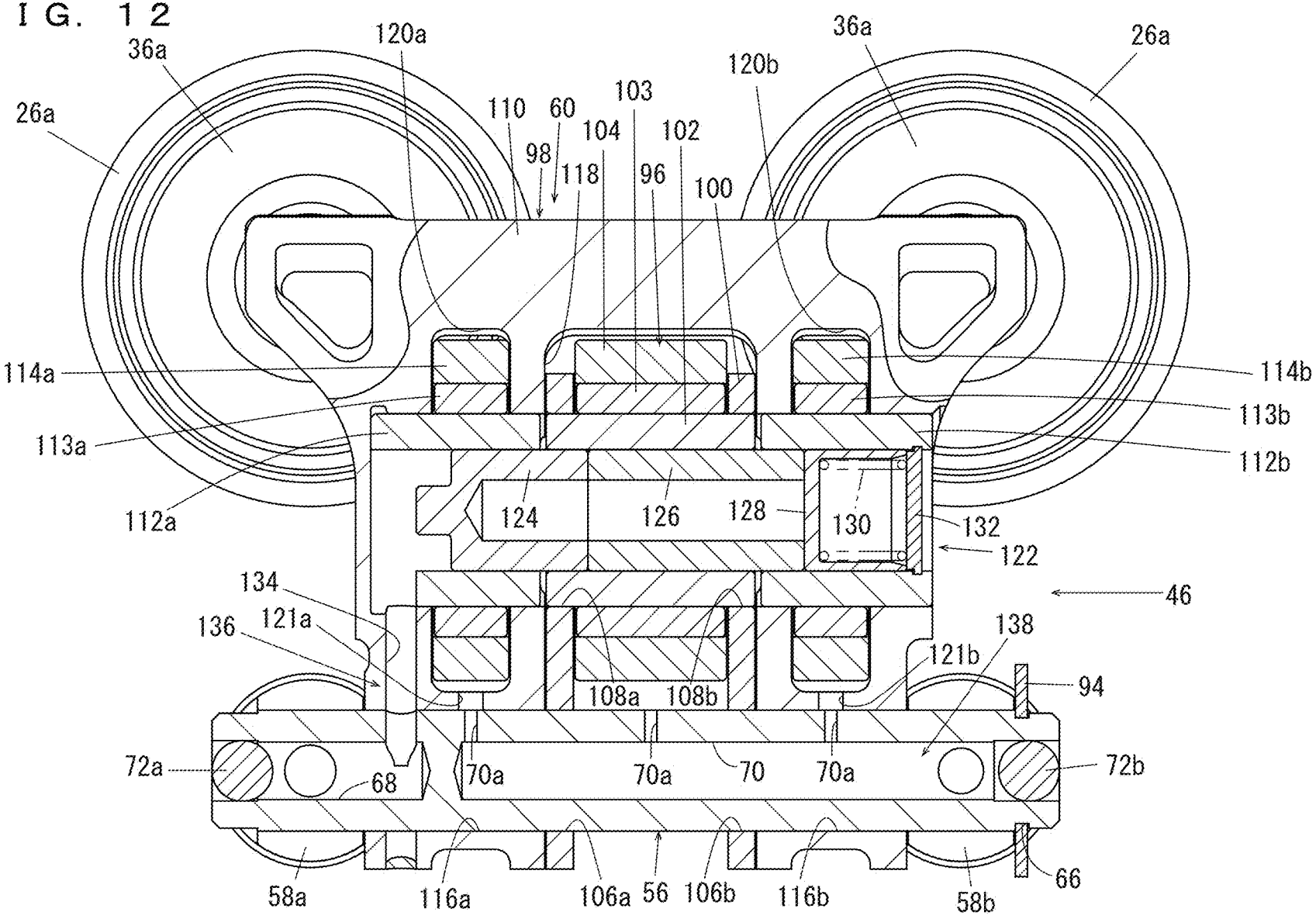
FIG. 12 is an illustrative sectional view which shows the valve gear and other components when the switch assumes a connected state.

Referring to FIG. 10 through FIG. 12, the rocker shaft 56 is bar-shaped or substantially bar-shaped, includes a concave portion 64 to receive a press-fit pin 92 (which will be described below) at a first end region, and an annular groove 66 to receive a circlip 94 (which will be described below) at a second end region. The rocker shaft 56 includes, inside thereof, a connection-switching oil path 68 and a lubrication oil path 70. The connection-switching oil path 68, which opens at the first end region of the rocker shaft 56, and the lubrication oil path 70, which opens at the second end region of the rocker shaft 56, sandwich a wall portion 71. The oil path 70 includes a plurality of (three, in the present preferred embodiment) shower portions 70*a* penetrating through the rocker shaft 56 and opening in an outer circumferential surface thereof. The shower portions 70*a* are provided axially along the rocker shaft 56 and spaced from each other at positions to oppose to cam followers 104, 114*a*, 114*b* (which will be described below). The oil paths 68, 70 have their respective ends fitted by ball-shaped plug members 72*a*, 72*b*, such that the openings of the oil paths 68, 70 are closed.

Figure 13:
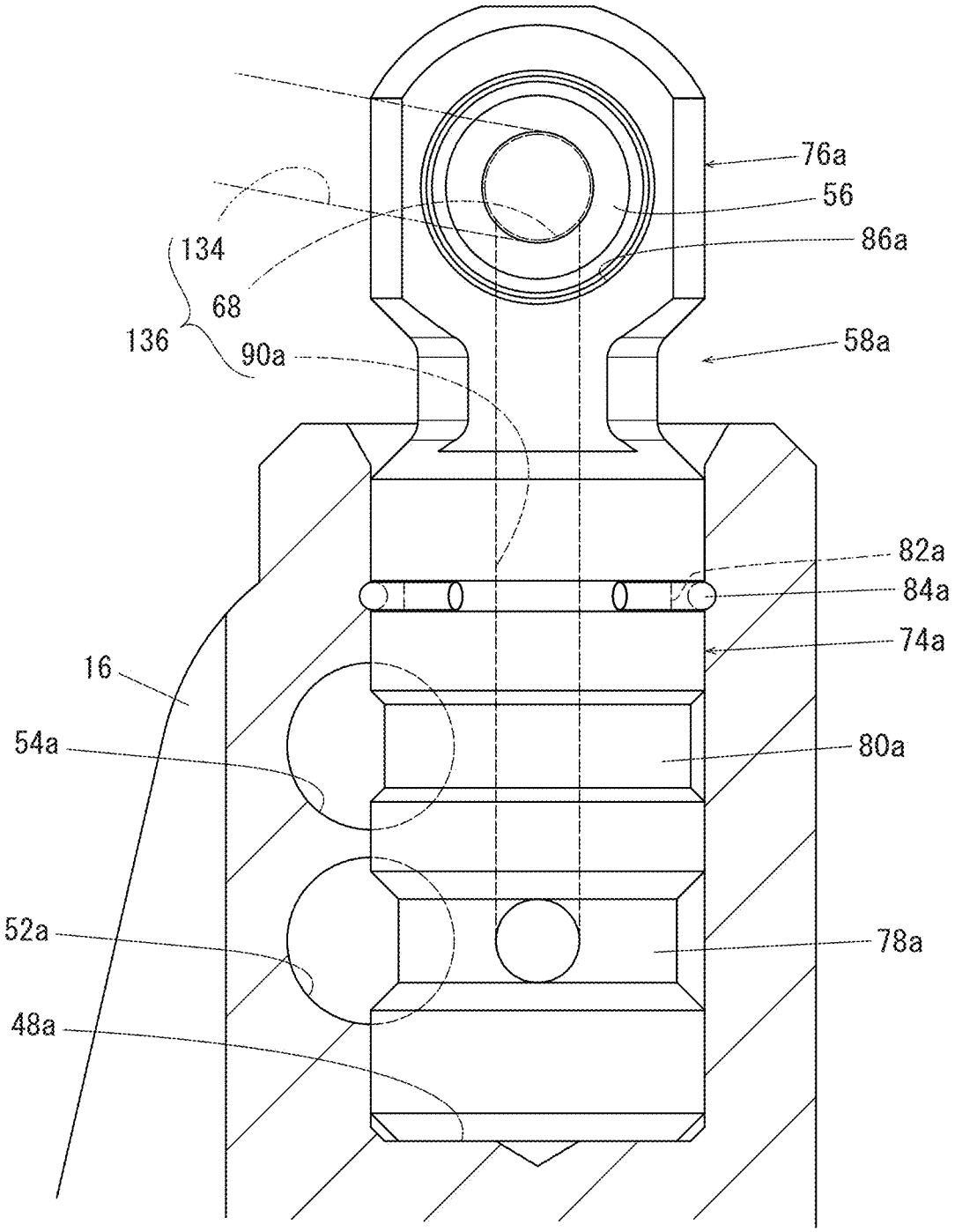
FIG. 13 is an illustrative drawing which shows an example of the first support attached to the cylinder head.

Referring further to FIG. 13, the first support 58*a* includes a substantially pillar-shaped main body 74*a* and a connecting portion 76*a* integral therewith at an end portion of the main body 74*a*. The main body 74*a* includes, on its outer surface, a first constriction 78*a* provided at an inlet of a third oil path 136 (which will be described below) and to connect to the first oil path 52*a*; a second constriction 80*a* to connect to the second oil path 54*a*; and a groove 82*a*. Each of the first constriction 78*a*, the second constriction 80*a*, and the groove 82*a* extends entirely around an outer surface of the first support 58*a*, i.e., they are annular shaped. A circlip 84*a* is attached to the groove 82*a* to prevent disengagement. The connecting portion 76*a* includes a through-hole 86*a* which penetrates the first support 58*a* perpendicular or substantially perpendicular to the longitudinal direction thereof, and a through-hole 88*a* corresponding to the concave portion 64 of the rocker shaft 56. The first support 58*a* includes a substantially T-shaped oil path 90*a* which starts from the first constriction 78*a* and extends to the through-hole 86*a* of the connecting portion 76*a*.

Figure 14:
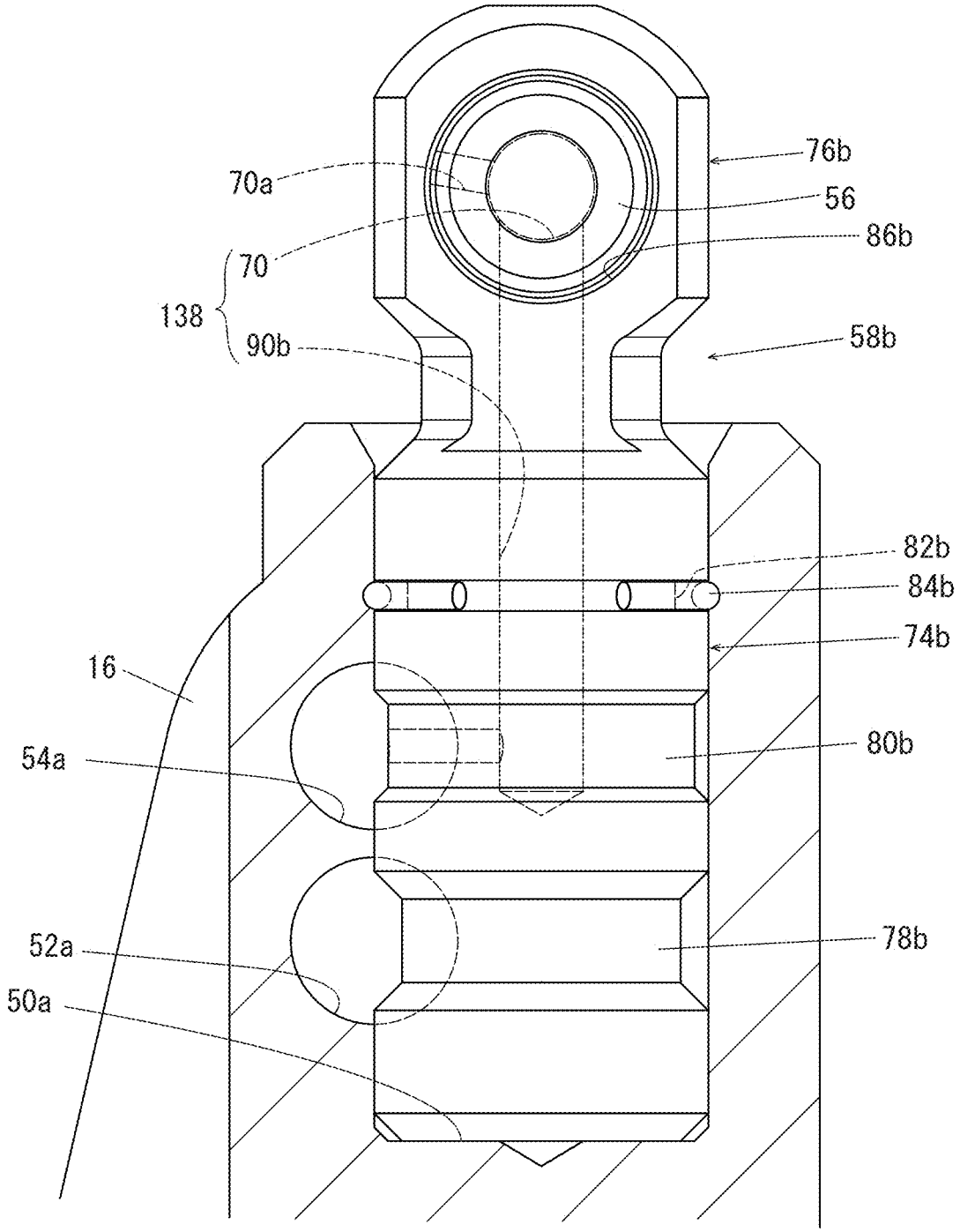
FIG. 14 is an illustrative drawing which shows an example of the second support attached to the cylinder head.

Referring further to FIG. 14, the second support 58*b* includes a substantially pillar-shaped main body 74*b* and a connecting portion 76*b* integral therewith at an end portion of the main body 74*b*. The main body 74*b* includes, on its outer surface, a third constriction 78*b* to connect to the first oil path 52*a*; a fourth constriction 80*b* provided at an inlet of the fourth oil path 138 (which will be described below) and to connect to the second oil path 54*a*; and a groove 82*b*. Each of the third constriction 78*b*, the fourth constriction 80*b*, and the groove 82*b* extends entirely around an outer surface of the second support 58*b*, i.e., they are annular shaped. A circlip 84*b* is attached to the groove 82*b* to prevent disengagement. The connecting portion 76*b* includes a through-hole 86*b* which penetrates the second support 58*b* perpendicular or substantially perpendicular to the longitudinal direction thereof, and a through-hole 88*b* similar to the through-hole 88*a*. The second support 58*b* includes a substantially L-shaped oil path 90*b* which extends from the fourth constriction 80*b* to the through-hole 86*b* of the connecting portion 76*b*.

The rocker shaft 56 is fitted with the first support 58*a*, the rocker arm 60, and the second support 58*b* in this order. The rocker shaft 56 is inserted through the through-hole 86*a* of the first support 58*a*, the through-holes 106*a*, 106*b*, 116*a*, 116*b* (which will be described below) of the rocker arm 60, and the through-hole 86*b* of the second support 58*b*. With these structural features, the first support 58*a* is positioned with respect to the rocker shaft 56 so as to align the through-hole 88*a* with the concave portion 64, and the press-fit pin 92 is pressed into the through-hole 88*a* and the concave portion 64 such that the first support 58*a* and the rocker shaft 56 are connected. Also, with the rocker arm 60 sandwiched between the first support 58*a* and the second support 58*b*, the second support 58*b* is positioned with respect to the rocker shaft 56, more closely to the first support 58*a* than the groove 66, and the circlip 94 is fitted around the groove 66. As described above, the circlip 94 is provided on the outer side of the connecting portion 76*b* in the rocker shaft 56 in order to prevent the second support 58*b* from detaching from the rocker shaft 56.

Figure 9:
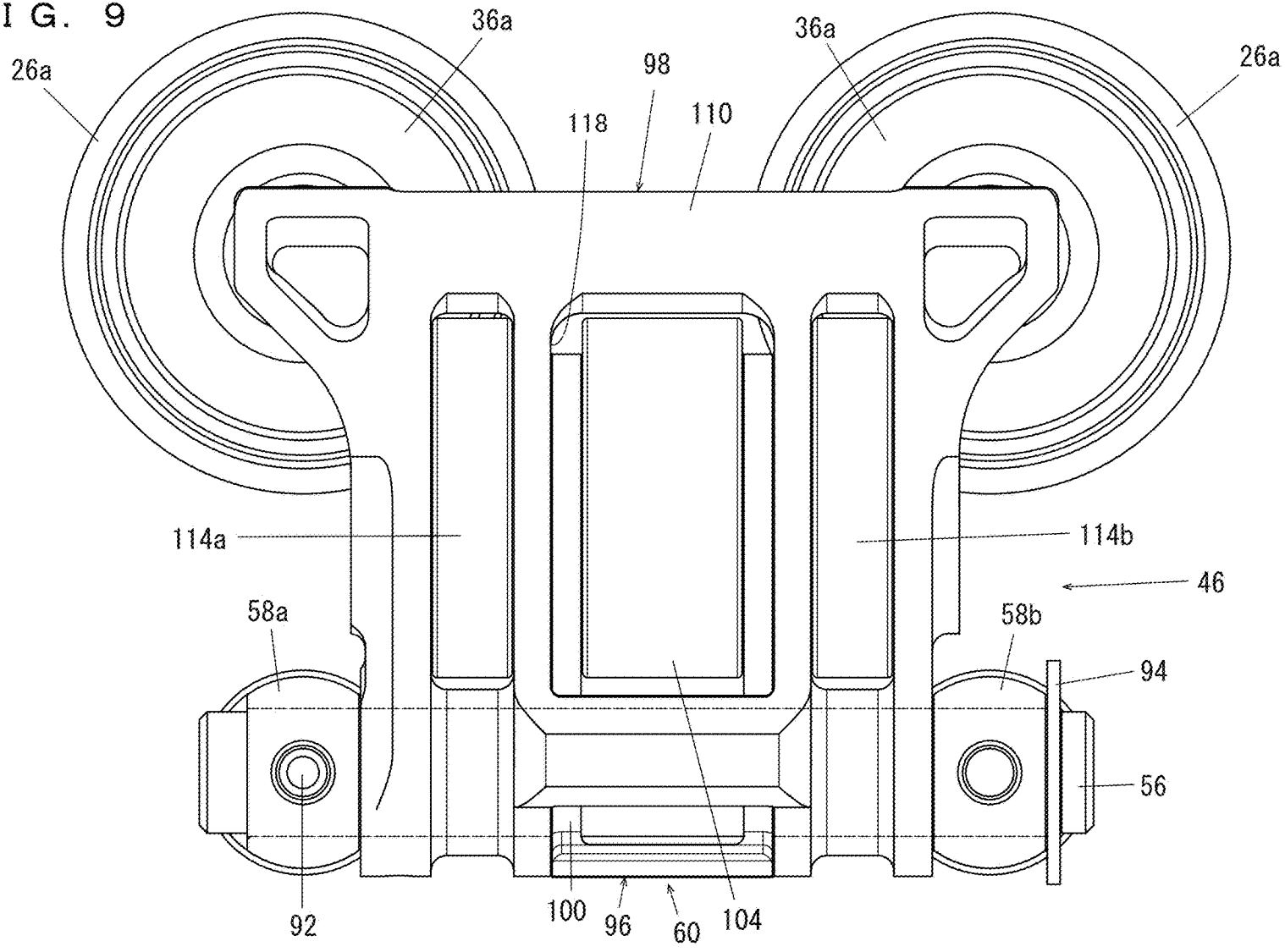
FIG. 9 is a plan view which shows the valve gear and other components.

Referring to FIG. 9, FIG. 11, and FIG. 12, the rocker arm 60 includes a first arm portion 96 and a second arm portion 98.

The first arm portion 96 is pivotably supported by the rocker shaft 56 and driven by the intake cam 42*a*. The second arm portion 98 is pivotably supported by the rocker shaft 56 and drivable by the intake cam 44*a*. Further, the second arm portion 98 pivots, and thus drives the intake valve 26*a*.

The first arm portion 96 includes a substantially frame-shaped arm main body 100 (see FIG. 4 through FIG. 8), a cylindrical collar 102, a bearing 103, and a cam follower 104. The arm main body 100 includes through-holes 106*a*, 106*b* and through-holes 108*a*, 108*b*. The rocker shaft 56 is inserted through the through-holes 106*a*, 106*b* such that the arm main body 100 is pivotably supported on the rocker shaft 56. The collar 102 is fitted into the through-holes 108*a*, 108*b* such that the collar 102 is held at two sides of the arm main body 100. The cam follower 104 is rotatable around an outer circumference of the collar 102 via the bearing 103. The cam follower 104 makes sliding contact with the intake cam 42*a*. The cam follower 104 faces one of the shower portions 70*a* of the oil path 70, from which lubricant oil is supplied to the cam follower 104 and the bearing 103.

The second arm portion 98 includes an arm main body 110, cylindrical collars 112*a*, 112*b*, bearings 113*a*, 113*b*, and cam followers 114*a*, 114*b*. The arm main body 110 includes through-holes 116*a*, 116*b*, a concave portion 118, concave portions 120*a*, 120*b*, and communication holes 121*a*, 121*b*. The concave portions 120*a*, 120*b* are provided on both sides of the concave portion 118. The rocker shaft 56 is inserted through the through-holes 116*a*, 116*b* such that the arm main body 110 is pivotably supported on the rocker shaft 56. The first arm portion 96 is located at the concave portion 118. The concave portions 120*a*, 120*b* are fitted respectively by the collars 112*a*, 112*b*. In the above arrangement, the collar 102 of the first arm portion 96 and the collars 112*a*, 112*b* of the second arm portion 98 are located axially along the rocker shaft 56, with the collars 112*a*, 112*b* sandwiching the collar 102. The collars 112*a*, 112*b* have their respective outer circumferences provided with the cam followers 114*a*, 114*b* rotatably supported by the bearings 113*a*, 113*b*. The cam followers 114*a*, 114*b* make sliding contact with the intake cams 44*a*, 44*a* respectively. The communication holes 121*a*, 121*b* provide communication between respective ones of the shower portions 70*a*, 70*a* of the rocker shaft 56 facing the cam followers 114*a*, 114*b* and the concave portions 120*a*, 120*b*. Therefore, lubrication oil is supplied from the shower portions 70*a*, 70*a* of the oil path 70 to the cam followers 114*a*, 114*b* and the bearings 113*a*, 113*b* via the communication holes 121*a*, 121*b*.

A switch 122 is placed inside of the collar 102 of the first arm portion 96 and the collars 112*a*, 112*b* of the second arm portion 98. The switch 122 is provided in the rocker arm 60 to hydraulically connect and disconnect the first arm portion 96 and the second arm portion 98 to/from each other. The switch 122 includes connecting pins 124, 126, 128, a spring 130, and a lid 132. The connecting pins 124, 126, 128, the spring 130, and the lid 132 are coaxial. The connecting pins 124, 126, 128 are slidably attached axially along the rocker shaft 56. The spring 130 is located between the connecting pin 128 and the lid 132. The connecting pin 128 is urged by the spring 130.

In order to supply hydraulic pressure to the switch 122, a connection-switching oil path 134 is provided inside the second arm portion 98. The oil path 134 is located in a region surrounded by the arm main body 110, the collar 112*a*, and the connecting pin 124.

Figure 7:
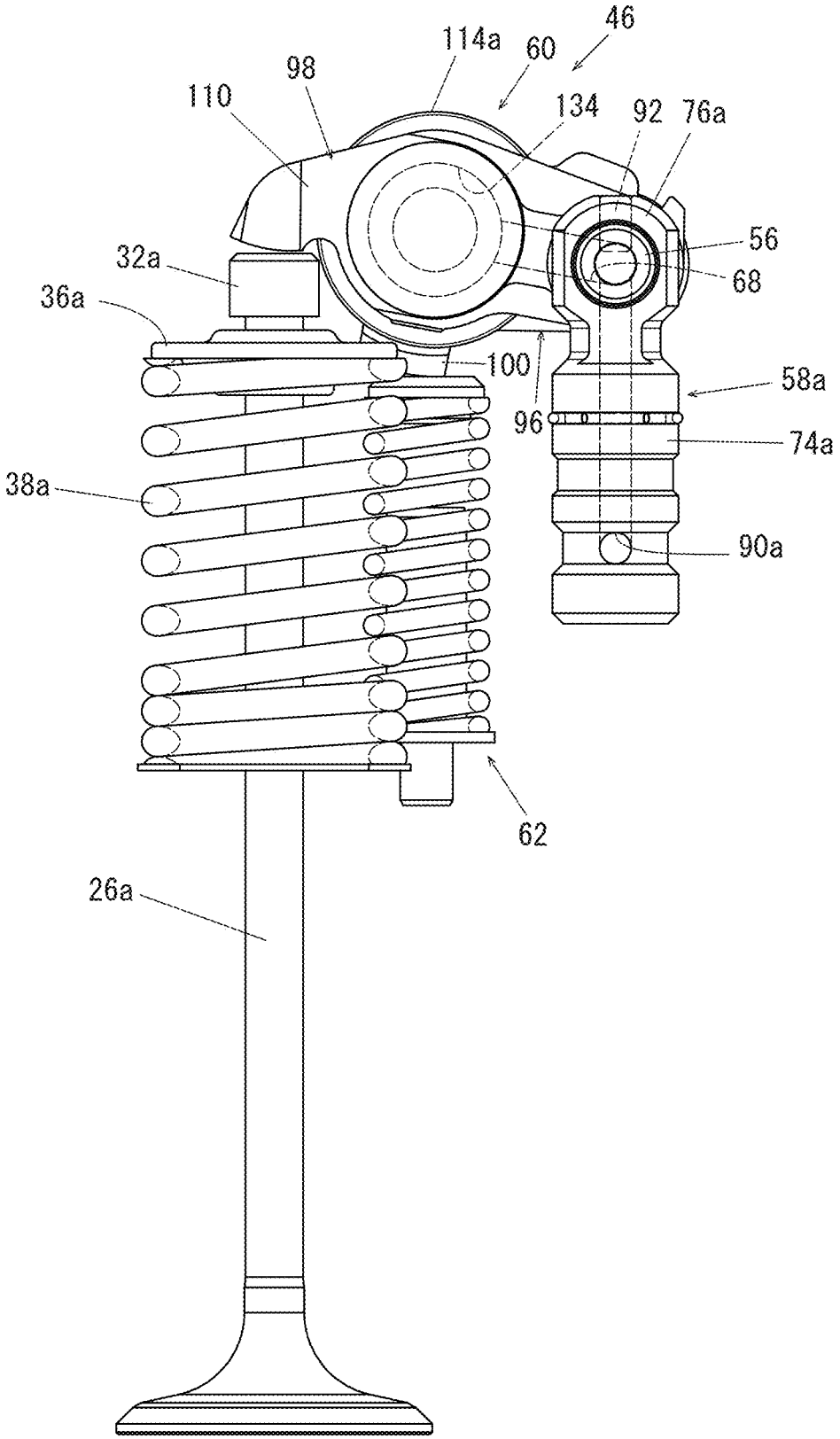
FIG. 7 is a side view which shows the valve gear and other components.
Figure 8:
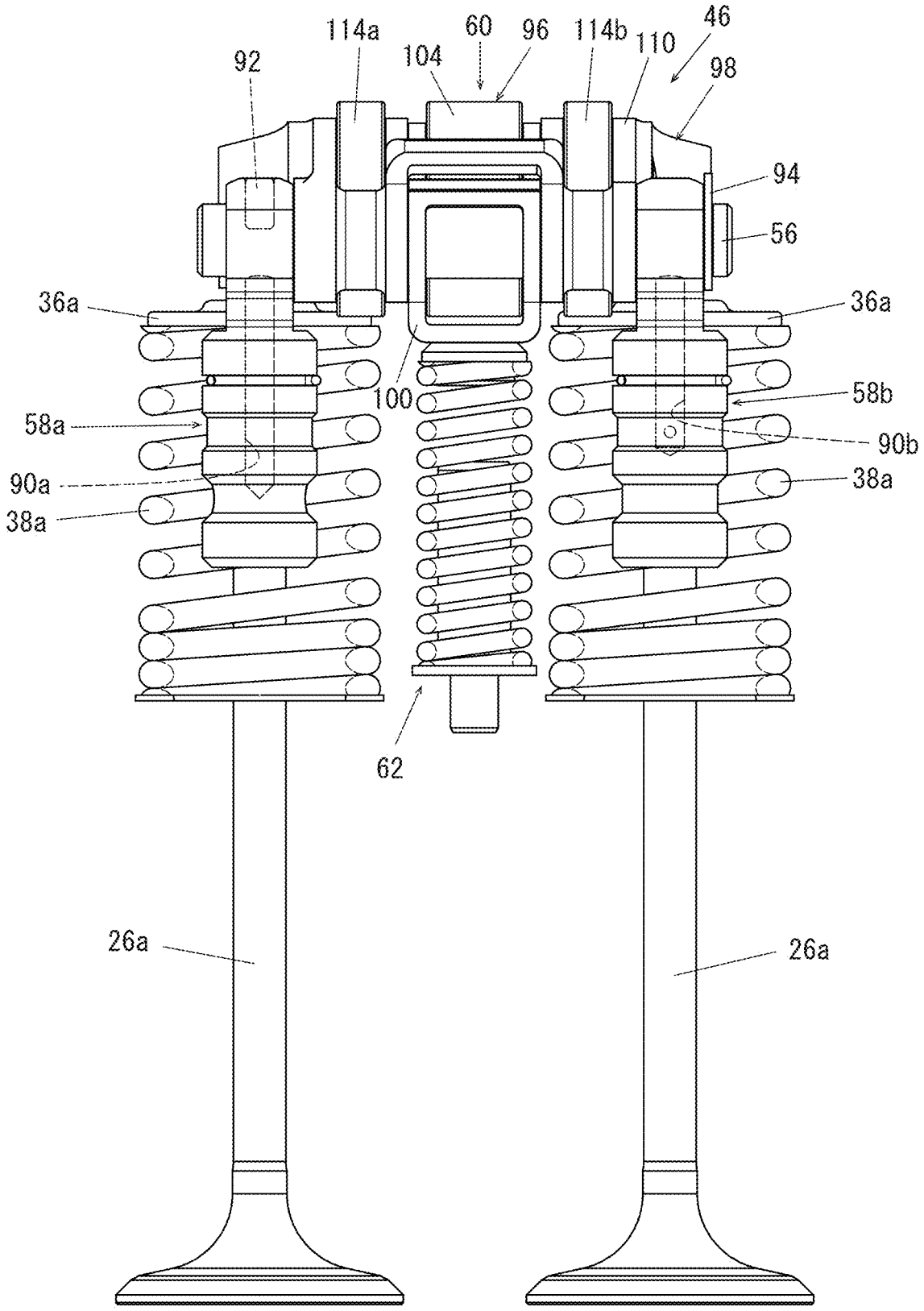
FIG. 8 is a rear view which shows the valve gear and other components.

The valve gear 46 includes a connection-switching third oil path 136 which includes the oil path 90*a* inside the first support 58*a*, the oil path 68 inside the rocker shaft 56, and the oil path 134 inside the rocker arm 60 (see FIG. 7 and FIG. 13). The third oil path 136 extends through the first support 58*a*, the rocker shaft 56, and the rocker arm 60 to the switch 122. Also, the valve gear 46 includes a lubrication fourth oil path 138 which includes the oil path 90*b* inside the second support 58*b*, and the oil path 70 inside the rocker shaft 56 (see FIG. 14). In order to lubricate areas between the intake cams 42*a*, 44*a* and the rocker arm 60, the fourth oil path 138 extends through the second support 58*b* and the rocker shaft 56 to a region between the rocker shaft 56 and the rocker arm 60.

The first support 58*a*, the second support 58*b*, the rocker shaft 56, and the rocker arm 60 described above are built into an assembly, which is then fixed onto the cylinder head 16 by inserting the first support 58*a* and the second support 58*b* into the first insertion hole 48*a* and the second insertion hole 50*a*, respectively. Thus, in the first support 58*a*, the first oil path 52*a* and the third oil path 136 communicate with each other via the first constriction 78*a*, while the second constriction 80*a* is connected to the second oil path 54*a*. Also, in the second support 58*b*, the third constriction 78*b* is connected to the first oil path 52*a*, while the second oil path 54*a* and the fourth oil path 138 communicate with each other via the fourth constriction 80*b*. The second support 58*b* is positioned at a more downstream side of the second oil path 54*a* than the first support 58*a*. Also, the lost motion mechanism 62 includes a lost motion spring 140 to urge the rocker arm 60 toward the intake cam 42*a*, and is fixed to the cylinder head 16.

Referring to FIG. 11, in the valve gear 46, when there is no hydraulic pressure supply from the third oil path 136 for connection-switching, the connecting pins 124, 126, 128 are urged by the spring 130 to slide leftward in FIG. 11. This brings the connecting pin 124 inside the collar 112*a*, the connecting pin 126 inside the collar 102, the connecting pin 128 inside the collar 112*b*, and the first arm portion 96 and the second arm portion 98 into a disconnected state. In the disconnected state, the connecting pins 124, 126, 128 do not connect the first arm portion 96 and the second arm portion 98 with each other. The first arm portion 96 and the second arm portion 98 are pivotable independently from each other around the rocker shaft 56 as a fulcrum point.

On the intake side, as the intake cam shaft 40*a* rotates, the intake cam 42*a* presses the cam follower 104 in sliding contact therewith, which makes the first arm portion 96 pivot around the rocker shaft 56; independently from this, as the intake cam shaft 40*a* rotates, the two intake cams 44*a* press the corresponding cam followers 114*a*, 114*b* in sliding contact therewith which makes the second arm portion 98 pivot around the rocker shaft 56. Therefore, without being affected by the action of the first arm portion 96, the second arm portion 98 presses the two intake valves 26*a* such that the two air inlets 24*a* of the intake port 20*a* are opened.

On the other hand, referring to FIG. 12, when there is connection-switching hydraulic pressure supplied from the third oil path 136, the connecting pins 124, 126, 128 slide rightward in FIG. 12 against the force of the spring 130. This brings the connecting pin 124 inside the collar 102*a* and the collar 112*a*, the connecting pin 126 inside the collar 102 and the collar 112*b*, and the first arm portion 96 and the second arm portion 98 into a connected state. In the connected state, the first arm portion 96 and the second arm portion 98 are connected with each other by the connecting pins 124 and 126 thus becoming integrally pivotable around the rocker shaft 56.

On the intake side, as the intake cam shaft 40*a* rotates, the intake cam 42*a* presses the cam follower 104 in sliding contact therewith which makes the first arm portion 96 and the second arm portion 98 pivot integrally with each other around the rocker shaft 56. As a result, the second arm portion 98 presses the two intake valves 26*a* such that the two air inlets 24*a* of the intake port 20*a* are opened. In this case, the second arm portion 98 moves the intake valve 26*a* by a lift amount (an amount the valve is opened), which is determined by a pivot action of the first arm portion 96 that pivots integrally with the second arm portion 98.

In the present preferred embodiment, the first constriction 78*a*, the second constriction 80*a*, the third constriction 78*b*, and the fourth constriction 80*b* correspond to the first concave portion, the second concave portion, the third concave portion, and the fourth concave portion, respectively. The press-fit pin 92 corresponds to the first regulator, the connecting portion 76*b* corresponds to the second regulator, and the circlip 94 corresponds to the retainer.

In the engine 10 which includes the valve gear 46 described thus far, the first support 58*a* has its outer surface provided with the first constriction 78*a* as the first concave portion connected to the first oil path 52*a* (52*b*) such that it becomes possible to reduce a decrease in a cross-sectional area in the first oil path 52*a* (52*b*) where the junction is made with the first support 58*a*; and is provided with the second constriction 80*a* as the second concave portion connected to the second oil path 54*a* (54*b*) such that it becomes possible to reduce a decrease in a cross-sectional area in the second oil path 54*a* (54*b*) where the junction is made with the first support 58*a*. Also, the second support 58*b* has its outer surface provided with the third constriction 78*b* as the third concave portion connected to the first oil path 52*a* (52*b*) such that it becomes possible to reduce a decrease in a cross-sectional area in the first oil path 52*a* (52*b*) where the junction is made with the second support 58*b*; and provided with the fourth constriction 80*b* as the fourth concave portion connected to the second oil path 54*a* (54*b*) such that it becomes possible to reduce a decrease in a cross-sectional area in the second oil path 54*a* (54*b*) where the junction is made with the second support 58*b*. Therefore, it becomes possible to reduce a delayed response in the connection-switching hydraulic pressure of the rocker arm 60, and in the lubrication hydraulic pressure between the rocker arm 60 and the intake cams 42*a*, 44*a* (the exhaust cams 42*b*, 44*b*), and to supply a stable hydraulic pressure.

In the engine 10, the first support 58*a* and the second support 58*b* are inserted respectively through the first insertion hole 48*a* (48*b*) and the second insertion hole 50*a* (50*b*) such that the cylinder head 16 is provided with the valve gear 46. Then, the first constriction 78*a* and the second constriction 80*a* as the first concave portion and the second concave portion of the first support 58*a* are connected to the first oil path 52*a* (52*b*) and the second oil path 54*a* (54*b*) respectively, while the third constriction 78*b* and the fourth constriction 80*b* as the third concave portion and the fourth concave portion of the second support 58*b* are connected to the first oil path 52*a* (52*b*) and the second oil path 54*a* (54*b*) respectively. Therefore, it is possible to reduce a decrease in a cross-sectional area in the first oil path 52*a* (52*b*) and the second oil path 54*a* (54*b*), and as a result, it is possible to reduce a delayed response in the connection-switching hydraulic pressure of the rocker arm 60, and in the lubrication hydraulic pressure between the rocker arm 60 and the intake cams 42*a*, 44*a* (the exhaust cams 42*b*, 44*b*), and to supply a stable hydraulic pressure.

By providing the first constriction 78*a* and the second constriction 80*a* around the entire circumference of the outer surface of the first support 58*a*; and providing the third constriction 78*b* and the fourth constriction 80*b* around the entire circumference of the outer surface of the second support 58*b*, it becomes possible to reduce more effectively the amount of decrease in the cross-sectional area of the first oil path 52*a* (52*b*) which is connected to the first constriction 78*a* and the third constriction 78*b*, and the amount of decrease in the cross-sectional area of the second oil path 54*a* (54*b*) which is connected to the second constriction 80*a* and the fourth constriction 80*b*.

The first support 58*a* and the second support 58*b* are identical in the shape of their outer surface. This makes it possible to substantially standardize the machining processes of the outer surfaces of the first support 58*a* and the second support 58*b*, and therefore makes it possible to reduce costs.

By regulating movement in the rotational and axial directions of the rocker shaft 56 using the press-fit pin 92 as the first regulator, it is possible to maintain positions of the first support 58*a* and the rocker shaft 56 so as to provide communication between the oil path 90*a* inside the first support 58*a* in the third oil path 136 for connection-switching of the rocker arm 60 and the oil path 68 inside the rocker shaft 56 at an appropriate location.

The first regulator is a small member, i.e., the press-fit pin 92. Thus, preferred embodiments of the present invention provide a high level of freedom in layout, making it possible to fix the rocker shaft 56 and the first support 58*a* reliably with each other.

By regulating movement of the rocker shaft 56 in directions perpendicular or substantially perpendicular to the axis of the rocker shaft 56 (including left-right directions and up-down directions of the rocker shaft 56) using the connecting portion 76*b* as the second regulator which connects the second support 58*b* and the rocker shaft 56 with each other, it is possible to stabilize the position of the rocker shaft 56, and to pivot the rocker arm 60 stably.

It is possible, with the circlip 94 as the retainer, to prevent the second support 58*b*, the rocker shaft 56, and the rocker arm 60 from separating from each other, which makes it easy to handle the valve gear 46 as an assembly during transportation, for example.

The circlip 94 adequately prevents separation yet it is easy to attach/detach, making it easy to perform repair work for the rocker arm 60 and, in addition, making it possible to provide at a lower cost.

In the engine 10, it is possible to reduce a decrease in the cross-sectional area in the second oil path 54*a* (54*b*) where the junction is made with the first support 58*a*, and supply a sufficient amount of lubrication oil between the rocker arm 60 and the intake cams 42*a*, 44*a* (the exhaust cams 42*b*, 44*b*), and to stabilize a pivoting movement of the rocker arm 60 with respect to rotation of the intake cams 42*a*, 44*a* (the exhaust cams 42*b*, 44*b*). Therefore, preferred embodiments of the present invention are suitable in cases where the second support 58*b* is located at a more downstream side of the second oil path 54*a* (54*b*) than the first support 58*a*.

It is possible to reduce the amount of decrease in the cross-sectional area in the first oil path 52*a* (52*b*) where the junction is made with the first support 58*a* and the second support 58*b* of each valve gear 46; and to reduce the amount of decrease in the cross-sectional area in the second oil path 54*a* (54*b*) where the junction is made with the first support 58*a* and the second support 58*b* of each valve gear 46. Therefore, it is possible to reduce a gap in the response in the connection-switching hydraulic pressure of the rocker arm 60 between the valve gears 46, and to supply a sufficient amount of lubrication oil even between the rocker arm 60 and the intake cams 42*a*, 44*a* (the exhaust cams 42*b*, 44*b*) that are located far from the hydraulic pressure source. Therefore, preferred embodiments of the present invention are suitable in a multi-cylinder engine such as the engine 10 which includes a plurality of cylinders disposed in-line.

Figure 15:
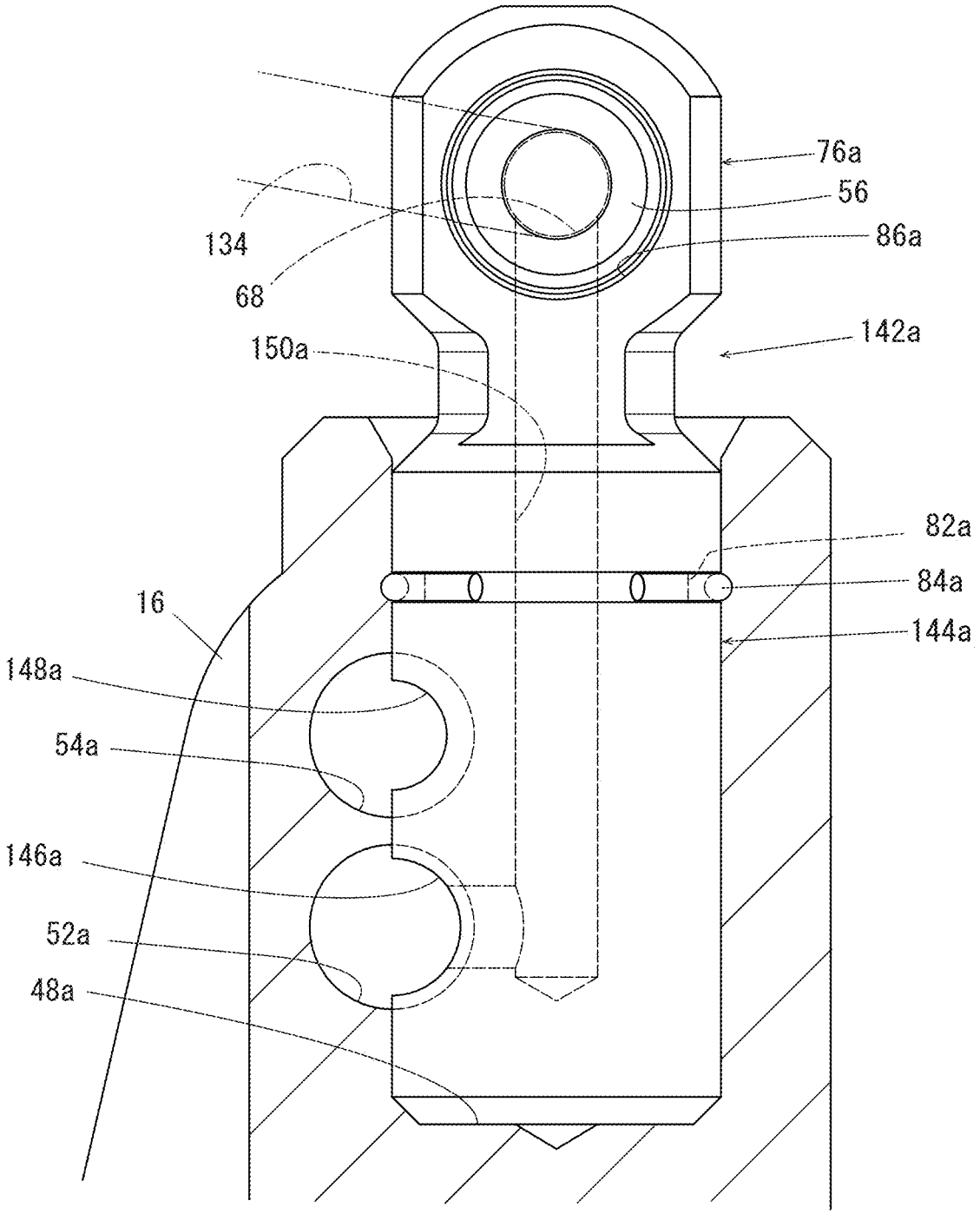
FIG. 15 is an illustrative drawing which shows a variation of the first support attached to the cylinder head.
Figure 16:
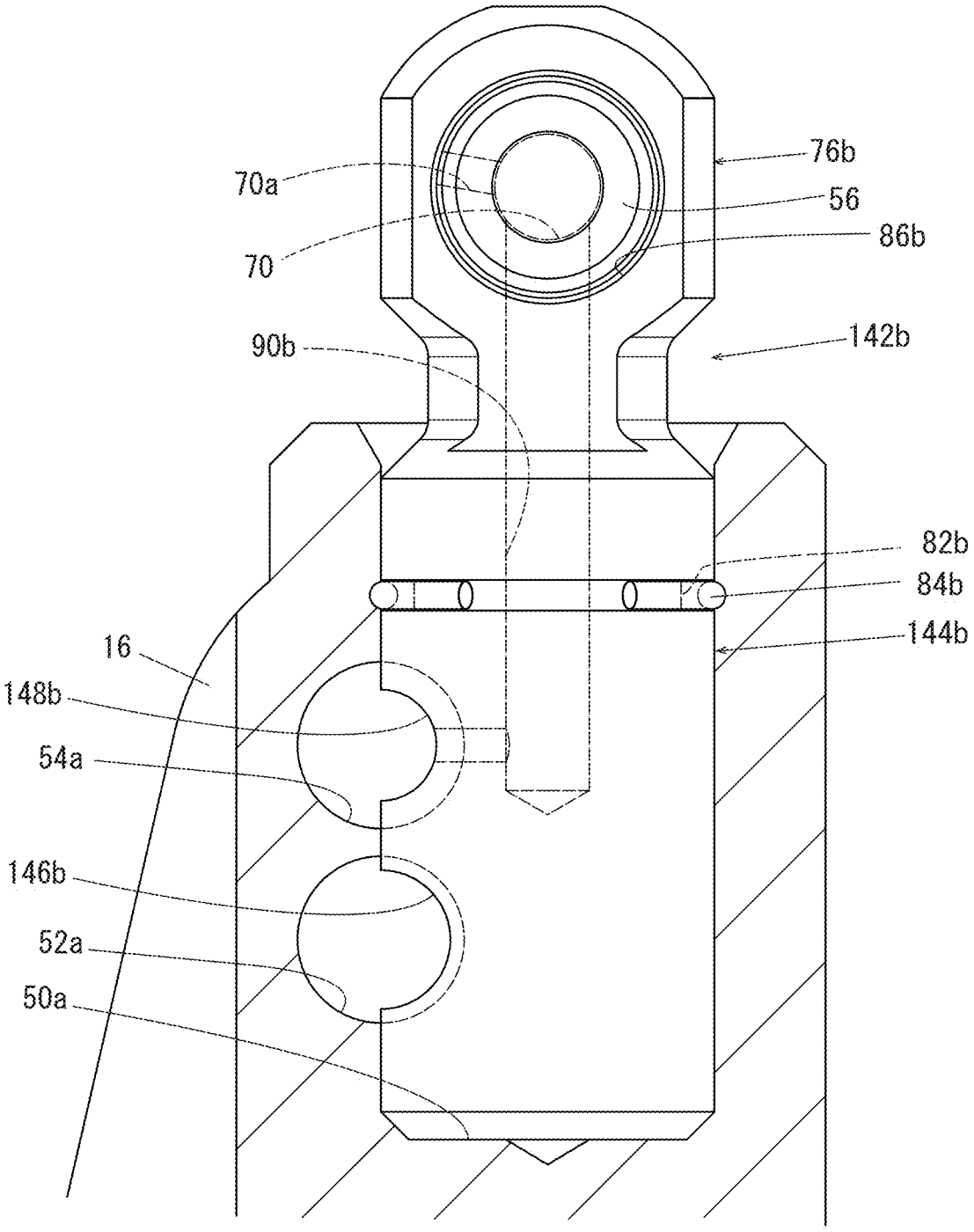
FIG. 16 is an illustrative drawing which shows a variation of the second support attached to the cylinder head.

The first support and the second support may be provided by a first support 142*a* and a second support 142*b* shown in FIG. 15 and FIG. 16.

The first support 142*a* in FIG. 15 differs from the first support 58*a* in FIG. 13 in that it includes a main body 144*a* in place of the main body 74*a*. The main body 144*a* differs from the main body 74*a* in that it includes a first concave portion 146*a*, a second concave portion 148*a*, and an oil path 150*a* in place of the first constriction 78*a*, the second constriction 80*a*, and the oil path 90*a*. The first concave portion 146*a* and the second concave portion 148*a* preferably have the shape of a hollow half-cylinder. The oil path 150*a* is connected to the first concave portion 146*a* and is substantially L shaped. Other arrangements in the first support 142*a* are the same as the first support 58*a*.

The second support 142*b* in FIG. 16 differs from the second support 58*b* in FIG. 14 in that it includes a main body 144*b* in place of the main body 74*b*. The main body 144*b* differs from the main body 74*b* in that it includes a third concave portion 146*b* and a fourth concave portion 148*b* in place of the third constriction 78*b* and the fourth constriction 80*b*. The third concave portion 146*b* and the fourth concave portion 148*b* preferably have the shape of a hollow half-cylinder. Other arrangements in the second support 142*b* are the same as the second support 58*b*.

The first support 142*a* and the second support 142*b* described above also provide the same advantages as the first support 58*a* and the second support 58*b*.

The preferred embodiments described thus far change the valve lift amount depending on whether or not the first arm portion 96 and the second arm portion 98 are connected with each other. However, preferred embodiments of the present invention are not limited to this. For example, whether or not the first arm portion 96 and the second arm portion 98 are connected with each may determine whether or not the valve is brought to an inactive state.

In the preferred embodiments described above, the engine 10 is a multi-cylinder engine. However, preferred embodiments of the present invention are not limited to this. Preferred embodiments of the present invention may also be applied to a single-cylinder engine.

In the preferred embodiments described above, the upstream side of the oil path is on the upper side in FIG. 2, and the downstream side of the oil path is on the lower side therein. However, preferred embodiments of the present invention are not limited to this, i.e., the flow may be reversed.

The engine according to preferred embodiments of the present invention may also be suitably installed in vehicles such as motorcycles, auto-tricycles, and ATVs (All Terrain Vehicles) as well as outboard engines, and others.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A valve gear for a cylinder head including a first oil path and a second oil path, the valve gear comprising:

a rocker shaft;

a first support that supports a first end region of the rocker shaft;

a second support that supports a second end region of the rocker shaft;

a rocker arm including a first arm portion supported pivotably by the rocker shaft and pivoted by a cam, and a second arm portion supported pivotably by the rocker shaft to drive a valve;

a switch provided in the rocker arm to hydraulically connect and disconnect the first arm portion and the second arm portion to/from each other;

a third oil path extending through the first support, the rocker shaft, and the rocker arm to the switch to supply a hydraulic pressure to the switch; and a fourth oil path extending through the second support and the rocker shaft to a region between the rocker shaft and the rocker arm to lubricate areas between the cam and the rocker arm; wherein the first support includes, on its outer surface, a first concave portion located at an inlet of the third oil path and to connect to the first oil path, and a second concave portion to connect to the second oil path; and the second support includes, on its outer surface, a third concave portion to connect to the first oil path, and a fourth concave portion located at an inlet of the fourth oil path and to connect to the second oil path.

2. The valve gear according to claim 1, wherein the first concave portion includes a first constriction extending entirely around an outer circumference of the first support;

the second concave portion includes a second constriction extending entirely around the outer circumference of the first support;

the third concave portion includes a third constriction extending entirely around an outer circumference of the second support; and the fourth concave portion includes a fourth constriction extending entirely around the outer circumference of the second support.

3. The valve gear according to claim 1, wherein the first support and the second support have an identical outer surface shape.

4. The valve gear according to claim 1, further comprising:

a first regulator to connect the first support with the rocker shaft to regulate movement in a rotational direction and an axial direction of the rocker shaft.

5. The valve gear according to claim 4, wherein the first regulator includes a press-fit pin.

6. The valve gear according to claim 4, further comprising:

a second regulator to connect the second support with the rocker shaft to regulate movement of the rocker shaft in directions perpendicular or substantially perpendicular to the axial direction.

7. The valve gear according to claim 6, further comprising:

a retainer provided on an outer side of the second regulator in the rocker shaft to prevent the second support from detaching from the rocker shaft.

8. The valve gear according to claim 7, wherein the retainer includes a circlip.

9. An engine comprising:

a cylinder head including a first insertion hole and a second insertion hole; and the valve gear according to claim 1; wherein the first support and the second support are inserted into the first insertion hole and the second insertion hole, respectively;

the first oil path and the third oil path communicate with each other via the first concave portion, and the second concave portion is connected to the second oil path in the first support; and the third concave portion is connected to the first oil path, and the second oil path and the fourth oil path communicate with each other via the fourth concave portion in the second support.

10. The engine according to claim 9, wherein the second support is located farther downstream in the second oil path than the first support.

11. The engine according to claim 9, wherein the cylinder head includes a plurality of cylinders located axially along the rocker shaft, the first insertion hole and the second insertion hole are provided for each cylinder of the plurality of cylinders and located axially along the rocker shaft;

each cylinder of the plurality of cylinders includes the valve gear; and each of the first oil path and the second oil path extends axially along the rocker shaft and is shared by the plurality of valve gears.

* * * * *